US010676247B2

(12) United States Patent
Umarov

(10) Patent No.: US 10,676,247 B2
(45) Date of Patent: Jun. 9, 2020

(54) DRIPLESS CAP AND CUP

(71) Applicant: UmaCor Design LLC, Weston, FL (US)

(72) Inventor: Maxim Umarov, Weston, FL (US)

( * ) Notice: Subject to any disclaimer, the term of this patent is extended or adjusted under 35 U.S.C. 154(b) by 0 days.

(21) Appl. No.: 16/377,915

(22) Filed: Apr. 8, 2019

(65) Prior Publication Data

US 2019/0233175 A1 Aug. 1, 2019

Related U.S. Application Data

(63) Continuation of application No. 15/619,750, filed on Jun. 12, 2017, now Pat. No. 10,308,399.
(Continued)

(51) Int. Cl.
*B65D 41/26* (2006.01)
*B65D 41/02* (2006.01)
(Continued)

(52) U.S. Cl.
CPC ..... *B65D 41/26* (2013.01); *B65D 47/12* (2013.01); *B65D 47/40* (2013.01); *B65D 41/02* (2013.01); *B65D 47/04* (2013.01)

(58) Field of Classification Search
CPC ..... B65D 41/26; B65D 41/02; B65D 41/265; B65D 41/16; B65D 47/04; B65D 47/12; B65D 47/40
(Continued)

(56) References Cited

U.S. PATENT DOCUMENTS 1,470,547 A 10/1923 Schilling
2,002,677 A 5/1935 Robinson
(Continued)

*Primary Examiner* — Nicholas J. Weiss
(74) *Attorney, Agent, or Firm* — Lee Sheikh Megley & Haan LLC

(57) ABSTRACT

A liquid bottle or container, such as for liquid detergent, and corresponding cap and cup is disclosed for operation in a horizontal position with the cap and cup side wall substantially parallel to the ground, the cap and cup shape providing a built-in drip collector cavity positioned around a portion of the circumference or perimeter of the cap and cup rim on the open end of the cap. The cap and cup may be used to cover a nozzle or other valve dispenser during storage. The drip collector cavity has a volume sufficient to collect liquid residue remaining after normal use of the cap as a measuring and dispensing cup, and any post-use drops from the dispenser nozzle. Thus, the cap and cup of the present disclosure is dripless or nearly drip less. In an embodiment, at least a portion of the cap rim perimeter around which no built-in drip collector cavity is positioned is shaped as a pouring spout. In another embodiment, the area of the liquid container body which receives the cap is shaped to have an indent to accept the pouring spout, thus acting as an orientation key. In yet another embodiment, the drip collector cavity includes one or more radial partitions providing additional rigidity and support to the rim. In another alternative embodiment, the cap and cup shape provides a built-in drip collector cavity at the closed end of the cap. The side wall along the lowest elevation has a negative slope such that when the cap and cup is in the generally horizontal storage position covering the nozzle dispenser, the lowest point of elevation of the rim of the cap and cup is a higher elevation than the lowest point of elevation of the closed end of the cap and cup, thus resulting in collection of liquid residue at and/or near the closed end of the cap and cup.

16 Claims, 4 Drawing Sheets

Related U.S. Application Data

(60) Provisional application No. 62/350,260, filed on Jun. 15, 2016.

(51) Int. Cl.
*B65D 47/12* (2006.01)
*B65D 47/40* (2006.01)
*B65D 47/04* (2006.01)

(58) Field of Classification Search
USPC ..... 222/108, 111
See application file for complete search history.

(56) References Cited

U.S. PATENT DOCUMENTS 2,584,522 A * 2/1952 Wolf ..... B65D 41/26 141/381
4,106,673 A * 8/1978 Donoghue ..... G01F 11/286 222/207
4,875,600 A 10/1989 D'Hoogue et al.
5,358,152 A 10/1994 Banks
5,651,481 A 7/1997 Jensen
5,794,803 A 8/1998 Sprick
D470,054 S 2/2003 Gerhart et al.
6,631,744 B1 10/2003 Gerhart et al.
7,147,020 B2 12/2006 Bronner
7,549,395 B2 * 6/2009 Stenberg ..... A01K 7/02 119/74
7,686,188 B2 3/2010 Stebick
7,743,798 B2 6/2010 Kunii
7,857,168 B2 12/2010 Horstman
D657,922 S 4/2012 Wolke
8,613,563 B2 12/2013 Chawla
9,446,885 B2 9/2016 Doubles et al.
2006/0138180 A1 6/2006 Giblin et al.
2012/0145710 A1 6/2012 Corbett
2016/0109276 A1 4/2016 Larson et al.

* cited by examiner

DRIPLESS CAP AND CUP

CROSS REFERENCE TO RELATED APPLICATIONS

The present application is a continuation of U.S. patent application Ser. No. 15/619,750, entitled "Dripless Cap and Cup," by the same inventor, filed Jun. 12, 2017, which claims the benefit of U.S. Provisional Application No. 62/350,260, entitled "Dripless Cap and Cup," by the same inventor, filed Jun. 15, 2016, the contents of all of which are herein incorporated by reference in their entirety.

FIELD

The present disclosure relates generally to caps for liquid bottles and, more particularly, to caps designed for the dual purposes of preventing drips and serving as cups for measuring liquid including, for example, detergent compositions such as laundry detergent.

BACKGROUND

Detergent compositions such as laundry detergents are often provided in the form of liquids or gels. Some detergent containers or bottles are provided with a measuring cup. Some containers have a built-in push-button nozzle or other valve dispenser. The nozzle dispenser containers are usually designed to operate in a horizontal position where the measuring cup is stored in a position with the measuring cup wall parallel to the ground. Thus, the measuring cup position is such that if the cup contained liquid, the liquid would pour out. In most instances, the measuring cup is covering the nozzle dispenser during storage and, thus, acts as a cap. The rim of the cap and cup creates a watertight or nearly watertight seal when snapped to the detergent bottle.

Due to the nature of the composition of liquid detergent, after using the measuring cup to dose the liquid detergent into a washing machine prior to the beginning of a wash cycle, liquid detergent residue, often a substantial amount, is left on the measuring cup walls and bottom.

Placing the measuring cup back into the designated horizontal storage position as a cap covering the nozzle dispenser after using the measuring cup to dose the liquid detergent leads to an amount of detergent, from the measuring cup walls and bottom, accumulated and trapped at the rim of the liquid detergent cup, where the detergent cup is snapped to the container. It is typically advised to rinse the measuring cup or to put it into the washing machine to remove the residue. However, small amounts of dripping from the dispensing nozzle create hazards and lead to product waste when the detergent cup is not placed back into position covering the nozzle dispenser promptly after use of the cup, Small amounts of dripping from the dispensing nozzle after the detergent cup is placed back into position also add to the amount of liquid detergent accumulated and trapped at the rim of the liquid detergent cup, where the detergent cup is snapped the container.

Removing the measuring cup after the liquid detergent is accumulated, from the measuring cup walls and bottom and/or the dripping nozzle, leads to spilling of the accumulated liquid detergent, thus creating hazards and product waste. Even before removing the measuring cup, leaking and/or dripping of the accumulated liquid may occur if the rim of the cup does not create a perfectly watertight seal when snapped to the detergent bottle.

The invention provides various ways to prevent, reduce and improve the problems of existing liquid detergent measuring cups by adding certain design elements to the detergent measurement cup and corresponding container.

SUMMARY OF THE INVENTION

A summary of certain embodiments disclosed herein is set forth below. It should be understood that these aspects are presented merely to provide a brief summary of these certain embodiments and that these aspects are not intended to limit the scope of this disclosure. This disclosure may encompass a variety of aspects that may not be expressly set forth below.

Embodiments of the present disclosure relate to caps for liquid bottles and, more particularly, to caps provided for the dual purposes of preventing drips and serving as cups for measuring liquid for liquid bottles that are designed to be stored and used in the horizontal position, such as laundry detergent bottles.

In accordance with some embodiments, a cap having a rim around an open end, a drip collector cavity positioned around a portion of the perimeter of the rim, and a side wall extending from the rim and the drip collector cavity to a closed end is disclosed. The drip collector cavity may be positioned around sixty to ninety percent (60-90%) of the perimeter of the rim. In some embodiments, the rim is circular, elliptical or ovular. At least a portion of the rim perimeter around which no built-in drip collector cavity is positioned may be shaped as a pouring spout. Additionally, the internal or external side wall of the cap may include one or more graduated lines for measuring a liquid. In some embodiments, the inside perimeter of the cap rim has a raised or depressed bead. In another embodiment, the drip collector cavity includes one or more radial partitions providing additional rigidity and support to the rim.

In accordance with some embodiments, a liquid container is disclosed. The liquid container comprises a cap further including an open end, a rim around the open end, a drip collector cavity positioned around a portion of the perimeter of the rim, a side wall extending from the rim and the drip collector cavity to a closed end, and a liquid container body adapted to receive the cap. In some embodiments, the drip collector cavity is positioned around sixty to ninety percent (60-90%) of the perimeter of the rim. In some embodiments, the rim is circular, elliptical or ovular.

In some embodiments of the disclosed liquid container, at least a portion of the cap rim perimeter around which no built-in drip collector cavity is positioned may be shaped as a pouring spout. In some embodiments, the area of the liquid container body which receives the cap is shaped to have an indent to accept the pouring spout. The internal or external side wall of the cap may include one or more graduated lines for measuring a liquid. In some embodiments of the liquid container, the inside perimeter of the cap rim has a raised or depressed bead, and the liquid container body may also have a raised or depressed bead that interacts or overlaps with the bead on the cap rim. In another embodiment, the drip collector cavity includes one or more radial partitions providing additional rigidity and support to the rim.

In an alternative embodiment, the cap and cup shape provides a built-in drip collector cavity at the closed end of the cap, the cap having an open end, a rim around the open end, a closed end, and a side wall extending from the rim to the closed end, the side wall having a negative slope along its lowest elevation when the cap is in a horizontal position, with the revolution center-axis of the cap parallel or substantially parallel to the ground, such that the lowest point of elevation of the rim is at a higher elevation than the lowest point of elevation of the closed end. In some embodiments, the rim is circular. In some embodiments, the closed end is elliptical. The cap may be one of an oblique cylindrical shape, oblique cut conical shape or oblique frustoconical shape. In certain embodiments, the side wall is straight around the entire perimeter and over the entire length of the cap. Alternatively, the cap may include a bulbous drip collector cavity shape around a portion of the closed end of the cap. At least a portion of the rim perimeter may also be shaped as a pouring spout. In some embodiments, the internal or external side wall of the cap includes one or more graduated lines for measuring a liquid. The inside perimeter of the cap rim may also have a raised or depressed bead.

An alternative embodiment of the liquid container is also disclosed including a cap with an open end, a rim around the open end, a closed end, and a side wall extending from the rim to the closed end, the side wall having a negative slope along its lowest elevation when the cap is in a horizontal position, with the revolution center-axis of the cap parallel or substantially parallel to the ground, such that the lowest point of elevation of the rim is at a higher elevation than the lowest point of elevation of the closed end, together with a liquid container body adapted to receive the cap. In some embodiments, the rim is circular. In some embodiments, the closed end is elliptical. The cap may be one of an oblique cylindrical shape, oblique cut conical shape or oblique frustoconical shape. In certain embodiments, the side wall is straight around the entire perimeter and over the entire length of the cap. Alternatively, the cap may include a bulbous drip collector cavity shape around a portion of the closed end of the cap. A portion of the rim perimeter is shaped as a pouring spout in some embodiments. Additionally, the area of the liquid container body which receives the cap may be shaped to have an indent to accept the pouring spout. The internal or external side wall of the cap may optionally include one or more graduated lines for measuring a liquid. The inside perimeter of the cap rim has a raised or depressed bead in certain embodiments. Additionally, the liquid container body may also have a raised or depressed bead that interacts or overlaps with the bead on the cap rim.

The brief summary presented above is intended only to introduce the reader with certain aspects and contexts of embodiments of the present disclosure without limitation to the claimed subject matter.

BRIEF DESCRIPTION OF THE DRAWINGS

Various aspects of this disclosure may be better understood by reading the following detailed description and by reference to the drawings in which.

DETAILED DESCRIPTION OF THE INVENTION

One or more specific embodiments of the present disclosure will be described below. These described embodiments are only examples of the presently disclosed apparatus. Additionally, in an effort to provide a concise description of these embodiments, all features of actual implementations may not be described. It should be appreciated that in the development of any such actual implementation, as in any engineering or design project, numerous implementation-specific decisions must be made to achieve the product developer's specific goals, such as compliance with regulatory and business constraints, which may vary among implementations. It should further be appreciated that such a product development effort would be an undertaking of design and manufacture for those of ordinary skill having the benefit of the present disclosure.

Figure 1:
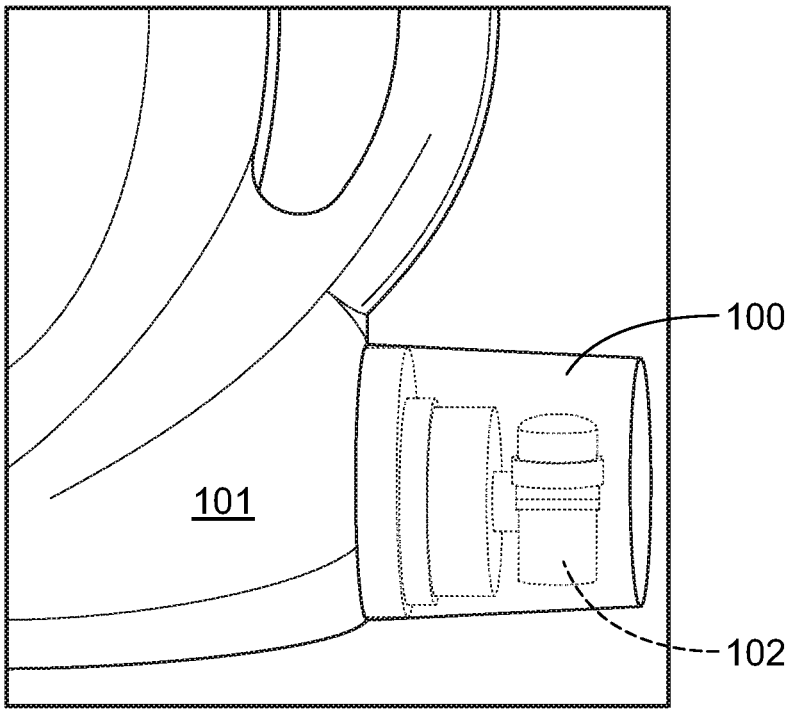
FIG. 1 (Prior Art)
FIG. 1 is a diagram of a three-dimensional view of a commonly used prior art liquid bottle and measuring cup.

As seen in FIG. 1, the measuring cup 100 of the prior art is not configured with a drip collector cavity. As such, it is problematic for the reasons previously discussed. In short when the measuring cup is placed back into position on the bottle 101 after use, liquid accumulates from the measuring cup walls and bottom and/or the dripping nozzle 102. This leads to spilling, leaking and dripping of liquid down the side of the bottle and/or on the floor, resulting in unsightly messes, hazards and product waste.

Figure 2:
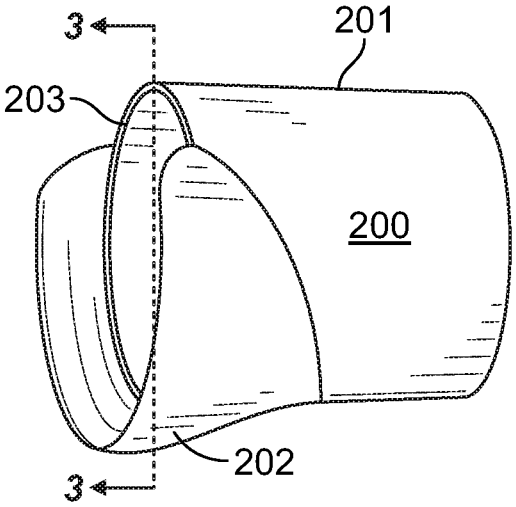
FIG. 2 is a perspective view of a dripless cap and cup, in accordance with some embodiments.
Figure 3:
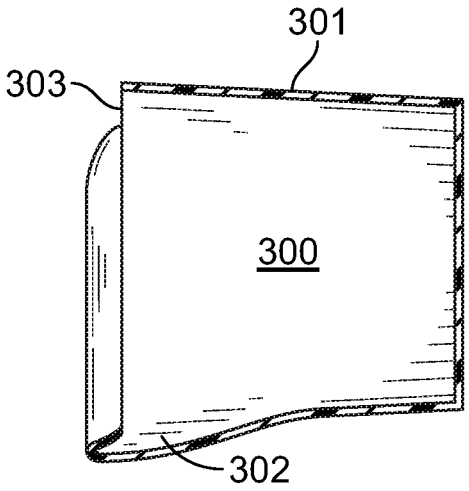
FIG. 3 is a section view of a dripless cap and cup, in accordance with some embodiments.
Figure 4:
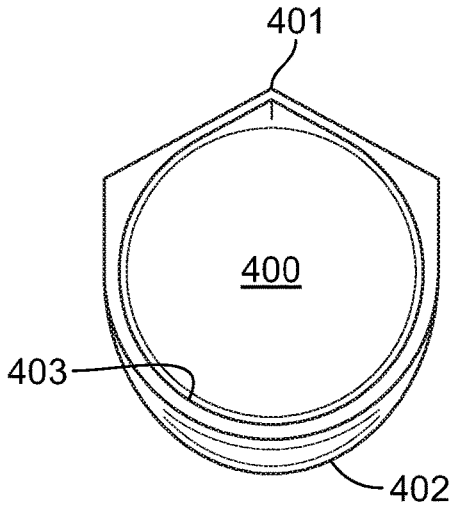
FIG. 4 is a front view of a dripless cap and cup, in accordance with some embodiments.
Figure 5:
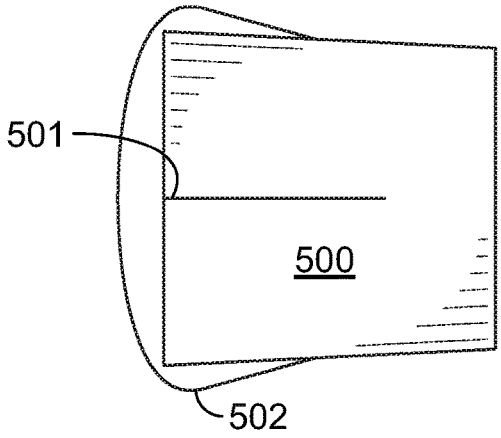
FIG. 5 is a top view of the dripless cap and cup of FIG. 4.
Figure 6:
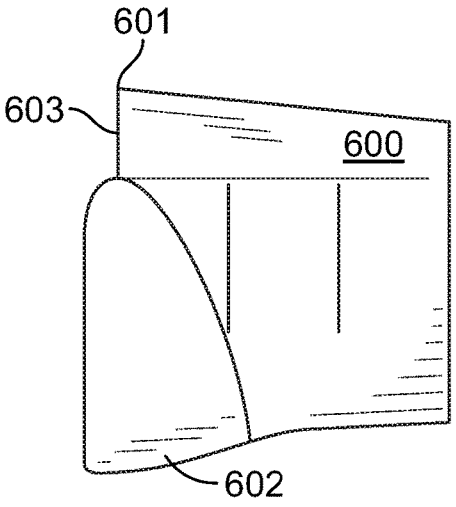
FIG. 6 is a side view of the dripless cap and cup of FIG. 4.
Figure 7:
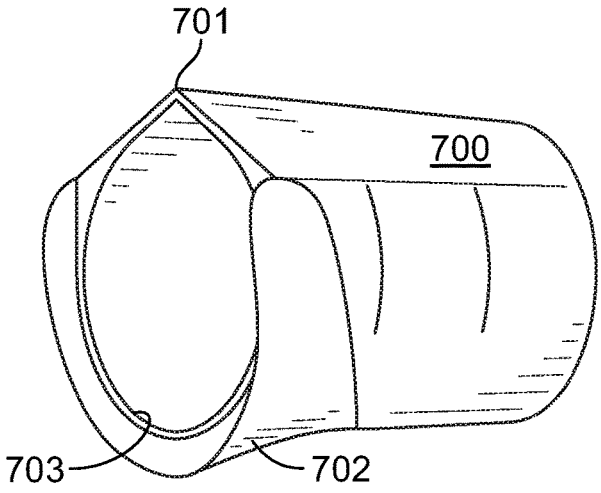
FIG. 7 is a perspective view of the dripless cap and cup of FIG. 4.

FIGS. 2-3 illustrate dripless caps and cups of the present disclosure, in accordance with some embodiments. The present disclosure teaches a liquid bottle cap and cup 200, 300 designed to operate in a horizontal position with the cap and cup side wall 201, 301 substantially parallel to the ground, and the cap and cup shape providing a built-in drip collector cavity 202, 302 positioned around a portion of the circumference or perimeter of the cap and cup rim 203, 303 on the open end of the cap, the "rim" being the edge around the open end of the cap. In an embodiment of the disclosure, the cap and cup shape provides a built-in drip collector cavity 202, 302 positioned around sixty to ninety percent (60-90%) of the circumference or perimeter of the cup rim 203, 303. The required percentage of rim circumference or perimeter around which the built-in drip collector cavity is positioned may depend on the width and depth of the built-in drip collector cavity 202, 302, the size of the cup, and the nature and flow characteristics such as viscosity of the liquid being stored.

The remaining percentage of rim circumference or perimeter, where no built-in drip collector cavity is required, remains with no built-in drip collector cavity. The cap side wall 201, 301 extends either from the rim 203, 303, where no built-in drip collector cavity is positioned, or from the drip collector cavity 202, 302, to a closed end of the cap such that when the cap is in the vertical position, it will hold liquid. In an embodiment of the cap and cup 400, 500, 600, 700 illustrated in FIGS. 4-8, at least a portion of the rim circumference or perimeter around which no built-in drip collector cavity is positioned can be shaped as a pouring spout 401, 501, 601, 701 to facilitate pouring.

The cap and cup in of the present disclosure includes cylindrical cup shapes, cut conical or frustoconical cup shapes and variations thereof as typically provided with liquid detergent containers. The cap and cup rim 203, 303, 403, 603, 703 is preferably substantially circular, elliptical or ovular, but may also take the shape of alternative closed figure forms. For the purposes of this description, the cap and cup vertical position is a standard drinking cup orientation for holding a liquid beverage with the closed bottom of the drinking cup at the lowest elevation point and the opening of the cup on the top at the highest elevation point. The cup horizontal position, as shown in FIGS. 1-10, is when the cup side wall is parallel or substantially parallel to the ground and/or revolution center-axis parallel or substantially parallel to the ground, such that if the cup contained liquid, the liquid would pour out. In an embodiment of the disclosure, the internal and/or external side wall of the cap includes one or more graduated lines for measuring a liquid, such as liquid laundry detergent, when the cap is used as a cup.

When the cap and cup is in the horizontal storage position covering the nozzle dispenser 102, the drip collector cavity 202, 302, 402, 502, 602, 702, extends down and outward below the rim 203, 303, 403, 603, 703 of the cap and cup such that any collected residue is situated below the point of contact between the cap and cup rim, on the one hand, and the detergent or other liquid container, on the other hand. The drip collector cavity has a volume sufficient to collect the liquid residue remaining after normal measuring cup use, and any post-use drops from the dispenser nozzle, provided that the nozzle 102 is functioning as intended, that is, the nozzle is not broken. As a result, the cap and cup of the present disclosure is dripless or nearly dripless. Thus, rather than dripping or leaking down the side of the bottle and/or on the floor, the collected liquid residue remains in the drip collector cavity 202, 302, 402, 502, 602, 702 until the next time the cap and cup is removed from the bottle and used to dose the liquid detergent into a washing machine prior to the beginning of a wash cycle. More specifically, when the cap and cup is removed from the container and tipped up into the vertical position, the collected liquid residue falls to the bottom of the cup and is used for the next dose. In this way, the embodiments of the drip collector cavity of the present disclosure prevent waste of liquid detergent or other liquid product. Other liquid products include all types of commercial or household liquid, such as cooking oil, that require measured dispensing and that have containers designed or that may be redesigned in the future to be used in the horizontal position. The embodiments described herein are applicable to all such liquids.

The required useable drip collector cavity volume may depend on the size of the cup, the tendency of the dispenser nozzle to produce post-use drops and the nature and flow characteristics such as viscosity of the liquid being stored. A series of tests using a non-drip collector cavity-equipped measuring cup to dispense 1.5 ounce (approximately 45 milliliters) doses of Tide® brand laundry detergent into a machine yielded approximately 6 milliliters of liquid residue remaining in the cup. Thus, a minimum of 7 to 10 milliliters of useable drip collector cavity volume would be required, depending on the factor of safety desired, even before accounting for any post-use drops from the dispenser nozzle or any additional liquid residue resulting from the addition of a drip collector cavity to the design of the cup. It is noted that Tide® brand liquid laundry detergent has a reported viscosity specification of 150-600 centipoise. Concentrated detergents may have higher viscosity ratings, such as 1200 centipoise or more. Useable drip collector cavity volumes of 20 milliliters or more may be required where the size and design of the cup and/or drip collector cavity increases the liquid residue remaining in the cup after dosing liquid, where the dispenser nozzle drips after use, and/or where higher viscosity liquid is in use. Notably, useable drip collector cavity volume, as used above, is the amount of liquid the drip collector cavity-equipped measuring cup can hold before liquid starts to flow over the lowest point of the rim when the cup is in the horizontal position and not snapped and sealed to a container.

In an embodiment, the inside diameter or perimeter of the cap and cup rim may have a small bead comprising a raised or depressed ring or circle. The bottle or container body receiving the cap may also contain a corresponding small bead that interacts or overlaps with the bead on the cap and cup rim. The cap and cup bead and the container body bead help secure the cap and cup to the container body, and generate an opening and closing force and a resultant snapping effect upon securing and removing the cap to and from the container body. The cap and cup bead and the container body bead may also generate a watertight or nearly watertight seal between the container body and cap.

Figure 9:
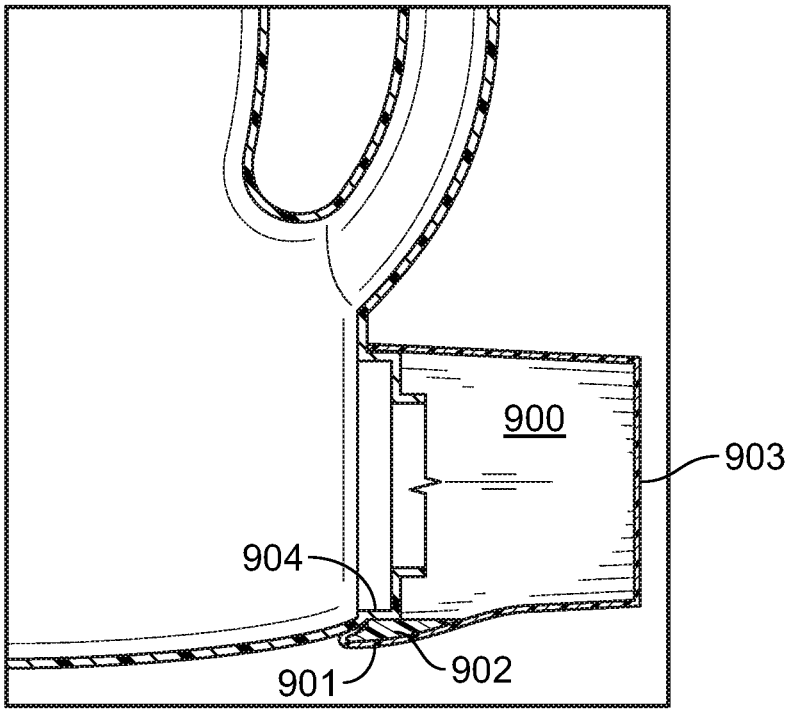
FIG. 9 is a section view of a liquid container with a dripless cap and cup, in accordance with other embodiments (nozzle dispenser not shown)

Because the plastic resin used to manufacture the cup may be flexible and elastic, the rim may change shape slightly, and resume or almost resume its normal shape, when the cup is snapped to the bottle. The drip collector cavity of the present disclosure may generally increase this flexibility and therefore decrease the amount of closing force required to snap the rim into the storage position on the container body. In turn, this may also lower the effectiveness of the seal between the container body and cap, to the extent the rim is flexed or yielded radially outward, Therefore, in another embodiment of the cap and cup 900 of the disclosure, an example of which is depicted in FIG. 9, it will be beneficial to have the drip collector cavity 901 include several (e.g. one, three, five) radial partitions 902, the partitions providing additional rigidity and support to the rim. As a result, when the closing force is applied to the closed end 903 of the cap and cup when the cap and cup is snapped back onto the container body 904, the radially outward flexing and/or yielding of the rim is reduced or eliminated by the partition walls, thus providing the same or substantially the same seal strength as with a straight-wall cap and cup.

Figure 8:
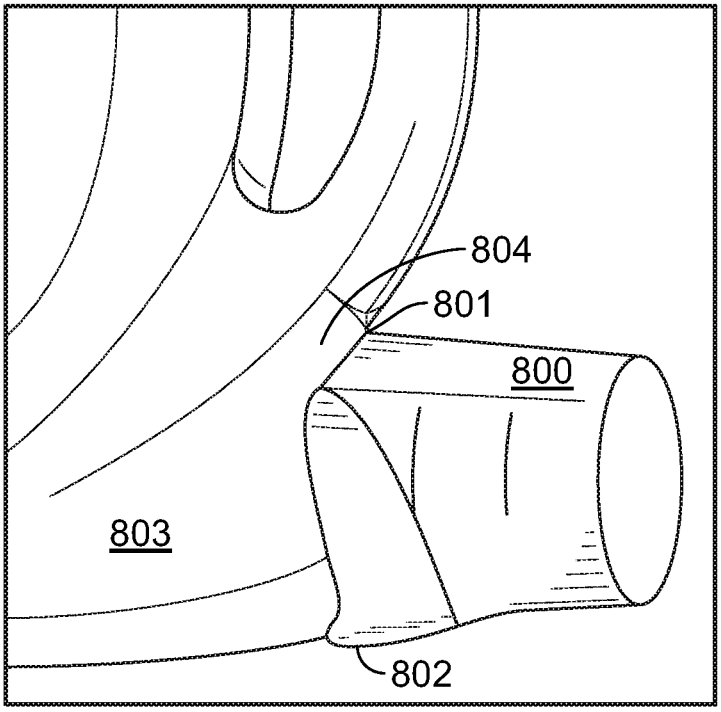
FIG. 8 is a perspective view of a liquid container with a dripless cap and cup, in accordance with some embodiments.

In another embodiment of the disclosure, an example of which is illustrated in FIG. 8, the poring spout can be used as an orientation key when returning the cap and cup 800 to the horizontal storage position, with the pouring spout tip 801 pointing up when the measuring cup is in the horizontal storage position. This orientation would ensure that the center of arc representing the lowest edge of the drip collector cavity 802 is always at the lowest possible elevation when the detergent cup is horizontal, thus maximizing the volume available for residue collection.

In another embodiment, also shown in FIG. 8, the liquid detergent (or other liquid) container 803 is designed to make it impossible to return the cap and cup 800 to the storage position with incorrect orientation by shaping the area 804 to which the cap and cup rim snaps onto to have an indent to accept the spout. Thus, the area 804 the cap and cup rim snaps onto acts as an orientation key.

Figure 10:
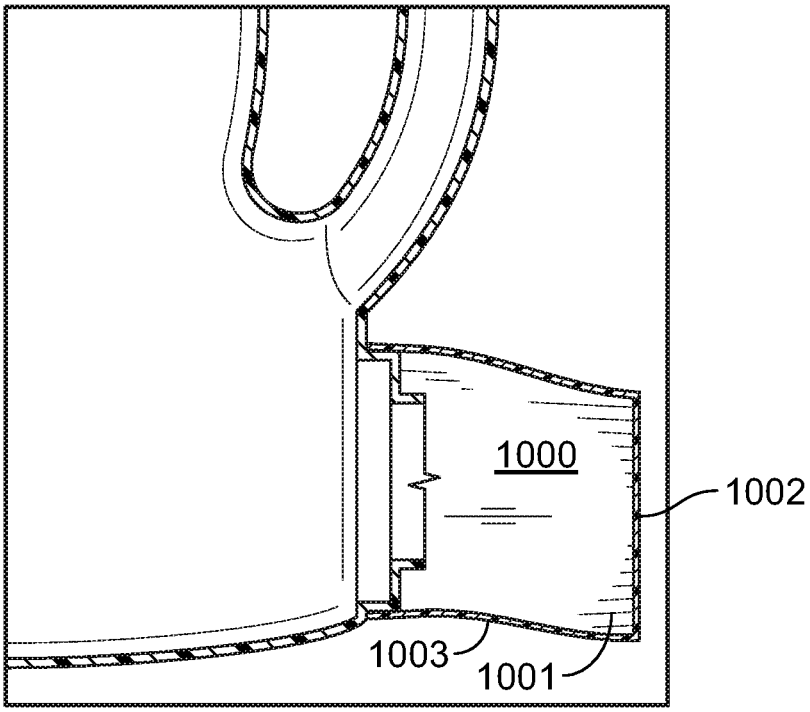
FIG. 10 is a section view of a liquid container with a dripless cap and cup, in accordance with alternative embodiments (nozzle dispenser not shown).

In another alternative embodiment, an example of which is shown in FIG. 10, the cap and cup 1000 shape provides a built-in drip collector cavity 1001 at the closed end 1002 of the cap. In this embodiment, the cap and cup 1000 is designed to operate in a generally horizontal position, with the revolution center-axis parallel or substantially parallel to the ground, as in other embodiments disclosed herein. However, rather than having the cap and cup side wall substantially parallel to the ground, the cap and cup side wall 1003 along the lowest elevation will have a negative slope such that when the cap and cup is in the generally horizontal storage position covering the nozzle dispenser, the lowest point of elevation of the rim of the cap and cup is at a higher elevation than the lowest point of elevation of the closed end of the cap and cup. As such, due to gravity, the liquid residue remaining after normal measuring cup use, as well as any post-use drops from the dispenser nozzle, will collect at and/or near the closed end 1002 of the cap and cup, this area being the drip collector cavity 1001 in this embodiment.

In the foregoing embodiment with the drip collector cavity 1001 at the closed end 1002, the cap and cup 1000 may include oblique cylindrical cup shapes, oblique cut conical or oblique frustoconical cup shapes and variations thereof. Thus, the elevation of the center point of the rim of the cap and cup may be at a higher elevation than the elevation of the center of the closed end of the cap and cup when the cap and cup is in the generally horizontal storage position. Alternatively, the closed end of the cap and cup may be generally elliptical (i.e. eccentricity greater than zero) while the rim of the cap and cup is generally circular (i.e. eccentricity at or near zero) such that, again, the lowest point of elevation of the rim of the cap and cup is at a higher elevation than the lowest point of elevation of the closed end of the cap and cup when the cap and cup is in the generally horizontal storage position.

In the various forms of the embodiment with the drip collector cavity at the closed end 1002, the cap and cup 1000 may have a straight side wall around the entire perimeter and over the entire length of the cap and cup because the drip collector cavity is created at and near the closed end of the cap and cup as a result of the afore-mentioned negative slope. The cap and cup 1000 may also have a curved side wall, as depicted in FIG. 10, with one or more negative slope(s) at least along the lowest elevation such that when the cap and cup is in the generally horizontal storage position covering the nozzle dispenser, the lowest point of elevation of the rim of the cap and cup is at a higher elevation than the lowest point of elevation of the closed end of the cap and cup, and liquid will collect at and/or near the closed end 1002 of the cap and cup due to gravity. For additional drip collector cavity volume, a bulbous drip collector cavity shape may be included around a portion of the closed end of the cap and cup. As in other embodiments, the required useable drip collector cavity volume may depend on the size of the cup, the tendency of the dispenser nozzle to produce post-use drops and the nature and flow characteristics such as viscosity of the liquid being stored. Like the required useable drip collector cavity volume, the required percentage of the perimeter of the closed end of the cap and cup around which the optional bulbous built-in drip collector cavity shape is positioned may depend on the width and depth of the built-in drip collector cavity, the size of the cup, and the nature and flow characteristics such as viscosity of the liquid being stored.

The disclosed cap and cup, as well as the body of the liquid container or bottle, may be manufactured out of low, medium or high-density polyethylene, polypropylene or other plastic resins, depending on the specified size/volume, nature of the liquid being stored and other safety, environmental, regulatory, cost and other business constraints. Such constraints may likewise influence the chosen manufacturing method, which is preferably injection molding. Other manufacturing methods include extrusion, blow extrusion and blow molding, often chosen depending at least in part on the material and volumes specified.

The present disclosure is not limited to the configurations herein, but rather the specific embodiments described above have been provided by way of example, and it should be understood that these embodiments may be susceptible to various modifications and alternative forms in accordance with the teachings of the present disclosure. It should be further understood that the claims are not intended to be limited to the particular forms disclosed, but rather to cover all modifications, equivalents, and alternatives falling within the spirit and scope of this disclosure.

What is claimed is:

1. A cap comprising:
an open end;
a rim around said open end;
a closed end; and
a side wall extending from said rim to said closed end, said side wall having a negative slope along its lowest elevation when the cap is in a horizontal position, with a revolution center-axis of the cap parallel or substantially parallel to the ground, such that a lowest point of elevation of the rim is at a higher elevation than a lowest point of elevation of the closed end, said side wall further having a negative slope along its highest elevation when the cap is in the horizontal position such that a highest point of elevation of the rim is at a higher elevation than a highest point of elevation of the closed end.

2. The cap of claim 1, wherein the rim is circular.

3. The cap of claim 1, wherein the cap has a generally oblique cylindrical shape such that an elevation of a center point of the rim is at a higher elevation than an elevation of a center point of the closed end when the cap is in the horizontal position.

4. The cap of claim 1, wherein the cap includes a bulbous drip collector cavity shape around a portion of the closed end of the cap.

5. The cap of claim 1, wherein at least a portion of the rim perimeter is shaped as a pouring spout.

6. The cap of claim 1, wherein the side wall of the cap includes one or more graduated lines for measuring a liquid.

7. The cap of claim 1, wherein the cap is polyethylene or polypropylene.

8. A liquid container comprising:
a cap further comprising:
an open end;
a rim around said open end;
a closed end; and
a side wall extending from said rim to said closed end, said side wall having a negative slope along its lowest elevation when the cap is in a horizontal position, with a revolution center-axis of the cap parallel or substantially parallel to the ground, such that a lowest point of elevation of the rim is at a higher elevation than a lowest point of elevation of the closed end, said side wall further having a negative slope along its highest elevation when the cap is in the horizontal position such that a highest point of elevation of the rim is at a higher elevation than a highest point of elevation of the closed end; and
a liquid container body adapted to receive the cap.

9. The liquid container of claim 8, wherein the rim is circular.

10. The liquid container of claim 8, wherein the cap has a generally oblique cylindrical shape such that an elevation of a center point of the rim is at a higher elevation than an elevation of a center point of the closed end when the cap is in the horizontal position.

11. The liquid container of claim 8, wherein the cap includes a bulbous drip collector cavity shape around a portion of the closed end of the cap.

12. The liquid container of claim 8, wherein at least a portion of the rim perimeter is shaped as a pouring spout.

13. The liquid container of claim 12, wherein an area of the liquid container body which receives the cap is shaped to have an indent to accept the pouring spout.

14. The liquid container of claim 8, wherein the side wall of the cap includes one or more graduated lines for measuring a liquid.

15. The liquid container of claim 8, wherein the cap is polyethylene or polypropylene.

16. The liquid container of claim 8, wherein the liquid container body is polyethylene or polypropylene.

* * * * *